US005740860A

United States Patent [19]

Crawford et al.

[11] Patent Number: 5,740,860

[45] Date of Patent: Apr. 21, 1998

[54] SIDE POCKET MANDREL FOR A MEASURING INSTRUMENT

[76] Inventors: William B. Crawford, 107 Llansfair Dr., Lafayette, La. 70503; Douglas W. Crawford, Rte. 1, Box 41X, Cushing, Tex. 75760; Mark S. Crawford, 5107 Graystone La., Houston, Tex. 77069

[21] Appl. No.: 628,984

[22] Filed: Apr. 8, 1996

[51] Int. Cl.[6] ..... E21B 47/00

[52] U.S. Cl. ..... 166/64; 166/66; 166/117.6

[58] Field of Search ..... 166/64, 65.1, 66, 166/117.5, 117.6

[56] References Cited

U.S. PATENT DOCUMENTS 3,939,705 2/1976 Glotin et al. ..... 73/151

4,846,269 7/1989 Schnatemeyer ..... 166/65.1

4,976,314 12/1990 Crawford et al. ..... 166/177.5

*Primary Examiner*—Roger J. Schoeppel

*Attorney, Agent, or Firm*—Bush, Riddle & Jackson, L.L.P.

[57] ABSTRACT

A side pocket mandrel arranged to receive a measuring instrument such as a pressure gauge in the open-bottomed side pocket thereof includes an electrical contact mounted at the top of the side pocket and connected to a cable extending upward to the surface, and an instrument lowered on a wireline kickover tool and inserted upward into the pocket and latched in place with a mating electrical connector automatically engaging the contact. Placement of the electrical contact at the top of the pocket prevents debris from settling around it and preventing reengagement after removal of the gauge for any reason.

10 Claims, 3 Drawing Sheets

SIDE POCKET MANDREL FOR A MEASURING INSTRUMENT

FIELD OF THE INVENTION

This invention relates generally to a mandrel that enables a measuring instrument to be retrievably installed in the production string of an oil well, and particularly to a unique side pocket mandrel having an offset bore and an electrical connection at the upper end thereof that permits a measuring instrument such as a pressure or temperature gauge to be run in on wireline, mated with the connection, and releasably latched into the bore without interference from debris or the like.

BACKGROUND OF THE INVENTION

Side pocket mandrels that accept a wire line retrieval pressure gauge are known. See Glotin et al U.S. Pat. No. 3,939,705. The gauge is connected via an external cable to the surface so that changes in tubing pressure and temperature at the level of the gauge can be measured downhole and recorded at the surface. However the device disclosed in this patent has a number of shortcomings. For example the male connector pin that connects the gauge to an external cable extends upward from a bore through a lower wall of the offset bore which has an open top. When the gauge is removed by a kickover tool for service, repair or replacement, debris in the mandrel and in the production string can fall down into, and settles out, in the lower end of the offset bore around the connector pin. When an attempt is made to run the gauge back to place, the female part of the connector encounters the debris and can not be made up with the male pin. Then the entire production string of tubing and mandrels will have to be pulled from the well in order to clean out the debris before rerunning the production string, which is a time consuming and costly operation. Moreover, the external electrical cable likely will have to be replaced on account of damage that usually occurs as the production string is pulled.

The general object of the present invention is to provide a new and improved side pocket mandrel of the type described which obviates the above-mentioned problems.

Another object of the present invention is to provide a new and improved side pocket mandrel of the type described where the electrical connection for the measuring instrument is at the top of the side pocket to prevent accumulation of debris around such connection.

SUMMARY OF THE INVENTION

These and other objects are attained in accordance with the concepts of the present invention through the provision of a side pocket mandrel having a main bore and a side pocket that is laterally offset to the side of the main bore and adapted to receive a measuring instrument such as a pressure gauge that is moved upward into it by a kickover tool. A seal bore at the upper end of the pocket extends upward through a wall of the mandrel and to the exterior thereof. An electrical connector member, preferably the male element, is mounted in a fluid-tight manner in the seal bore with the male pin projecting downward into the upper end of the pocket. The external portion of the connector member is coupled to an electrical cable that extends upward along the tubing to the surface.

An orienting sleeve is fixed in the mandrel at the lower end of the main bore, and provides guide surfaces that extend upward to a longitudinal slot that forms part of a T-shaped channel which cooperates with projections on the arm of a kickover tool to cause the arm and a measuring instrument attached thereto to be guided precisely into the offset bore during upward movement of the kickover tool in the main bore. The instrument has a companion electrical connector member such as the female element which mates with the male element as the instrument is moved fully upward in the pocket. A latch shoulder spaced a selected distance below the lower end of the seal bore cooperates with a collet on the measuring instrument to releasably latch the instrument in place. After latching, the running head on the arm assembly is released from the latch by jarring or the like, after which the arm assembly of the kickover tool is retracted so that it and the wireline can be removed from the well. After the gauge has been retrieved for any reason, it is impossible for debris to accumulate around the male element in a manner that might impede reconnection. Since the electrical connector is at the upper end of the side pocket, gravity can not cause settlement of any debris around or on such connection, and the ability to reconnect is preserved.

BRIEF DESCRIPTION OF THE DRAWINGS

The present invention has the above as well as other objects, features and advantages which will become more apparent in connection with the following detailed description of a preferred embodiment, taken in conjunction with the appended drawings in which.

DETAILED DESCRIPTION OF A PREFERRED EMBODIMENT

Figure 1:
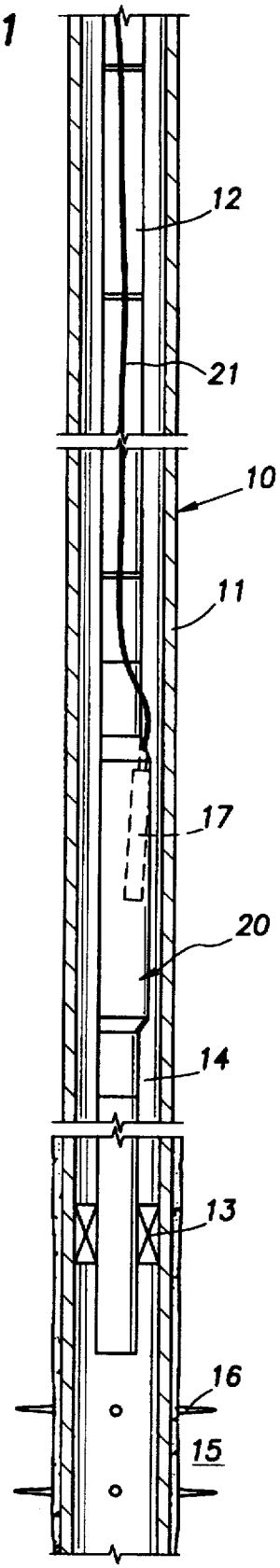
FIG. 1 is a schematic view of a well installation where the production string has a side pocket mandrel adapted to receive a measurement instrument in accordance with this invention.

Referring initially to FIG. 1, a well bore 10 that is lined with a casing 11 has a production string 12 of robing therein which extends from the surface down to a packer 13 that seals off the annulus 14. Fluids from the formation 15 enter the casing 11 through perforations 16 and then pass upward through the packer 13 and the tubing 12 to the surface. The tubing 12 includes a side pocket mandrel 20 as an integral part thereof, such mandrel being constructed in accordance with this invention. The mandrel 20, which is located above the packer 13, is adapted to receive a measuring instrument 17 such as a gauge that measures the pressure or temperature of fluids flowing upward through the tubing 12. The instrument 17 is electrically connected by a connector assembly c to an electrical cable 21 that extends upwardly along the exterior of the tubing 12 to the surface. Typically the cable 21 is strapped to the tubing 12 at spaced points after the threaded connections are made up during lowering so as to protect and support the cable. The cable 21 has at least one internal insulated conductor to furnish power to, and to receive signals transmitted from, the measuring instrument 17 so that signals representative of pressure and/or temperature over time can be recorded and/or displayed at the surface. Of course a significant decline in bottomhole pressure over time generally indicates depletion, and can be used to determine when the well should be put on gas or other artificial lift.

Figure 2:
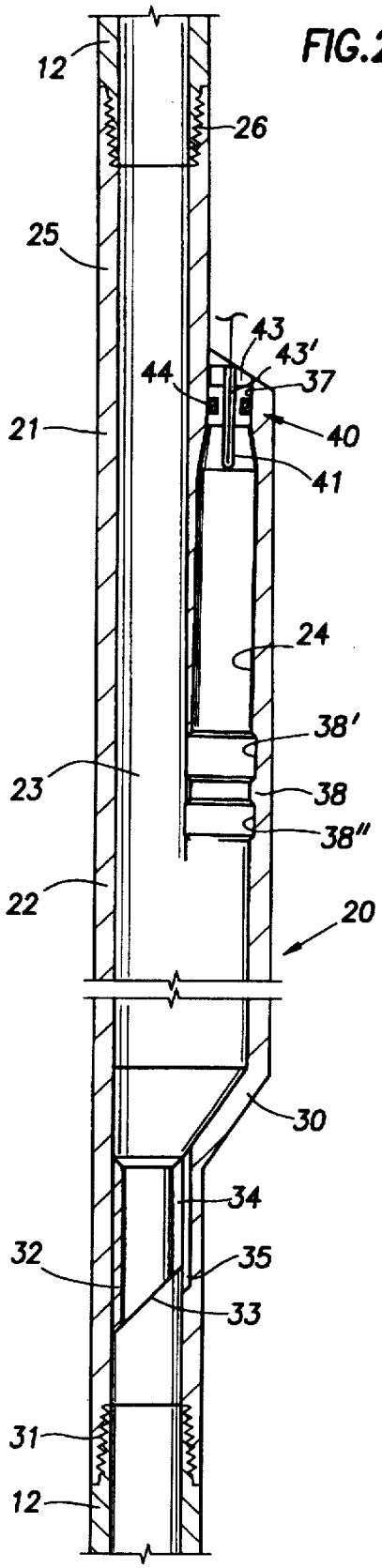
FIG. 2 is a longitudinal section view of the side pocket mandrel of FIG. 1.
Figures 3, 4:
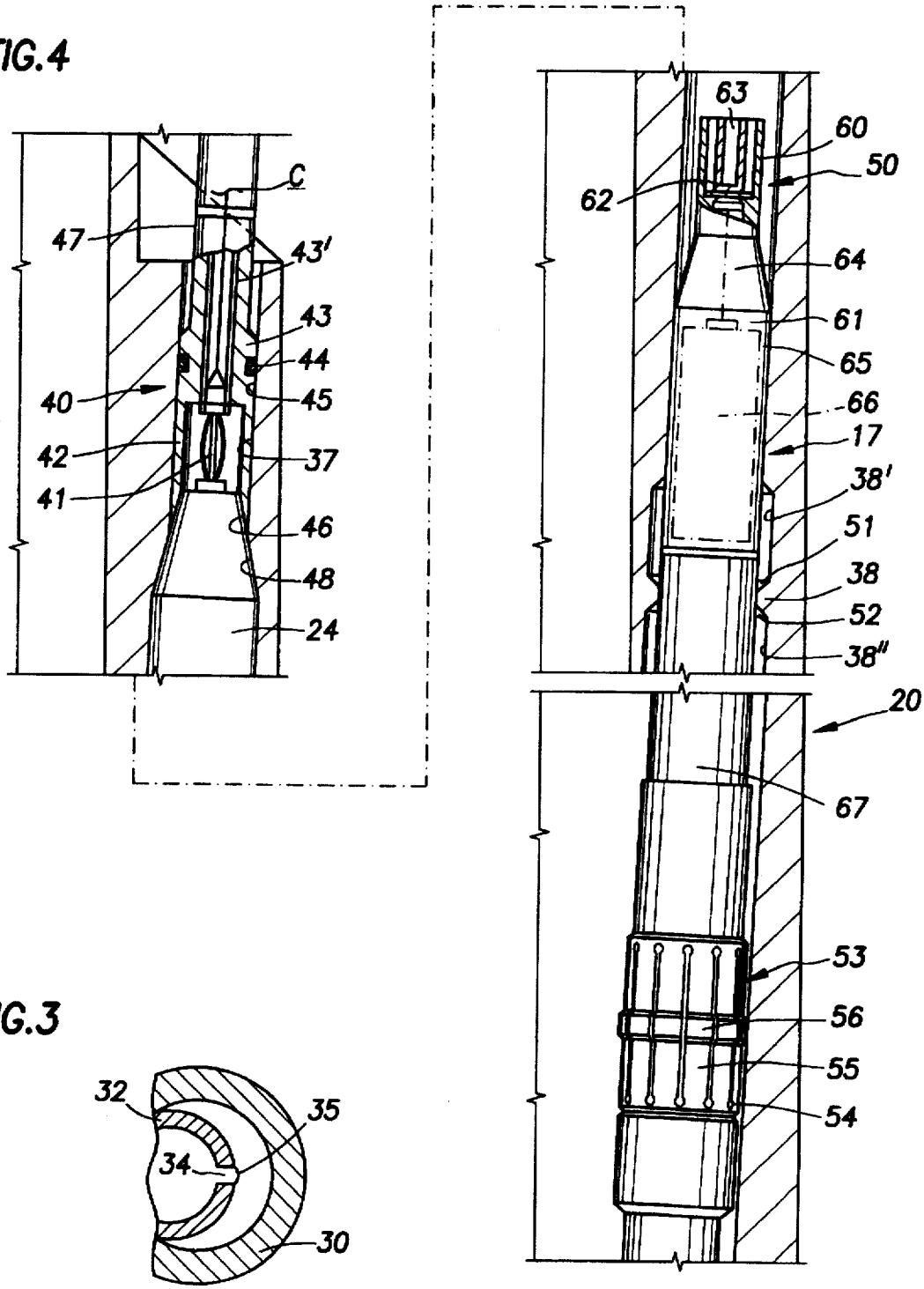
FIG. 3 is a cross-section on line 3—3 of FIG. 2.
FIG. 4 is an enlarged, quarter section showing the gauge and the electrical connectors as well as latching features.

As shown in FIG. 2, the side pocket mandrel 20 includes an elongated body section 22 that is generally tubular, and which defines a main bore 23 that is aligned with the bore of the tubing 12, and a side pocket region or bore 24 that is offset to the side of the main bore. The axis of the side pocket region 24 can be inclined at a low angle downward and inward toward the central axis of the main bore 23. A nipple 25 at the upper end of the mandrel 20 has a threaded box 26 which is screwed to a pin on the low end of the tubing joint 12. A swage section 27 is used to connect the nipple 25 to the top of the main body section 22. Another swage nipple 30 on the lower end of the body section 22 has internal threads 31 that connect to the tubing 12 therebelow. An orienting sleeve 32 fixed inside the nipple 30 forms helical guide surfaces 33 that lead upward to a longitudinal slot 34. A channel 35 that is wider than the slot 34 is formed in the nipple 30 in radial alignment with the slot as shown in FIG. 3, and the lower end of the channel extends somewhat below the lower end of the slot. Thus arranged, the slot 34 and the channel 35 form a "T"-shaped longitudinal recess which cooperates with projections on the pivot arm of a kickover tool as disclosed and claimed in my U.S. Pat. No. 4,976,314 which issued Dec. 11, 1990, and which is incorporated herein by express reference. The cooperation of the slot and the arm causes pivotal outward movement of the arm, and placement of a device attached thereto, in the side pocket region 24. Such placement occurs as the kickover tool, which is suspended in the tubing 12 on wireline, is moving upward through the main bore 23 of the mandrel 20.

A seal bore 37 that is coaxial with the side pocket 24 extends upward through the wall of the swage nipple 27 and opens to the exterior thereof. As noted above, the central axes of the bore 37 and the offset bore 24 can be, if needed, inclined at a low angle of about 1°–3° to the longitudinal axis of the main bore 23. An arcuate latch shoulder 38 and adjacent recesses 38 and 38' are formed a selected distance below the lower end on the seal bore 37. The upper end portion 39 of the bore 24 has a frusto-conical shape to provide a guide and stop surface for purposes to be described hereafter.

As shown in more detail in FIG. 4, a male electrical connector assembly 40 is mounted in the seal bore 37 and includes a pin 41 that projects downward in the center of an annular skirt 42. The pin 41 can be a "banana" type as shown, which is mounted on the lower end of a non conductive tube 43 that is fixed within an annular body 43. A conductor wire 43 goes up the center of the tube 43 and leads to cable connector C on the lower end of the cable 21. The body 43 can have threads (not shown) by which it is screwed into the seal bore 37, and carries a seal ring 44 that engages the inner wall 45 of the bore 37 to prevent fluid leakage. The upper end of the body 43 can have threads 47 by which a companion coupling that terminates the lower end of the electrical cable 21 is threaded and sealed thereto. The skirt 42 on the lower end of the body 43 has a downward and outwardly inclined inner surface 46 that is continued by a frusto-conical surface 48 which forms the upper portion on the side pocket 24. These surfaces serve to guide the mating female connector assembly 50 into engagement with the male connector assembly 40, and to provide a stop as will be described below.

The latch shoulder 38 is formed around the offset bore 24 of the mandrel 20 a selected distance below the lower end of the seal bore 37. The shoulder 38 has inclined upper and lower walls 51, 52 which define the respective lower and upper ends of internal recesses 38, 38'. Although other latch structures could be used, the measuring instrument 17 is shown as having a collet latch assembly 53 including a sleeve 54 thereon which is divided into a plurality of longitudinal flexible beams 55 by slits 56. Each beam 55 has an enlarged diameter portion 56 at its center which has upper and lower inclined walls as shown. As will be described below with reference to FIG. 7, an annular clearance space inside the beams 55 allows them to flex inward so that the portions 56 assume a smaller outer diameter in order to pass through the shoulder 38, and then resile outward to their initial diameter once they have passed such shoulder. A locking sleeve can move axially inside the collet sleeve 54 between one position where the beams 55 can flex inward and pass the shoulder 38, and another position where the portions 56 are supported radially and can not flex inward enough to release from the shoulder. If desired, the end portion of the measuring instrument 17 that is adjacent the collet sleeve 53 can be provided with a seal member 57 that provides an annular elastomer cushion and centralizer that engages the surrounding wall of the bore 24.

The female connector assembly 50 includes a tubular barrel 60 that is threaded to the housing 61 of the measuring instrument 17. The outer diameter of the barrel 60 is slightly less than the inner diameter of the skirt 42 so at to slide snugly into same. The barrel 60 houses a metal contact tube 62 having an internal bore 63 that receives the banana pin 41. A conductor wire 64 shown by a dash-dot-dash line leads from the tube 62 to a terminal 65 on the instrument 17. In the embodiment shown, an electronics section 66 outlined by dotted lines is connected to a pressure transducer that includes a diaphragm 67 which senses the pressure of fluids in the main bore 23 of the mandrel 20, and feeds signals to the electronic section 66. Thus an electrical signal is transmitted to the surface by the cable 21 which represents the pressure measurement.

Figure 5:
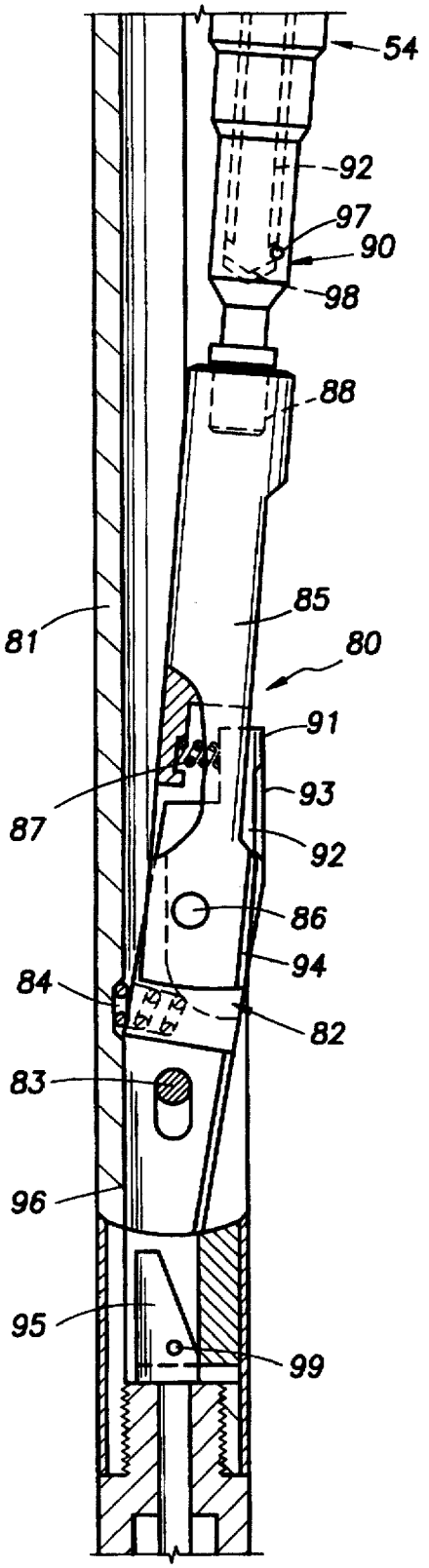
FIG. 5 is a sectional view with portion in side elevations, showing the main components of the kickover tool by which the instrument is set in the mandrel.
Figure 6:
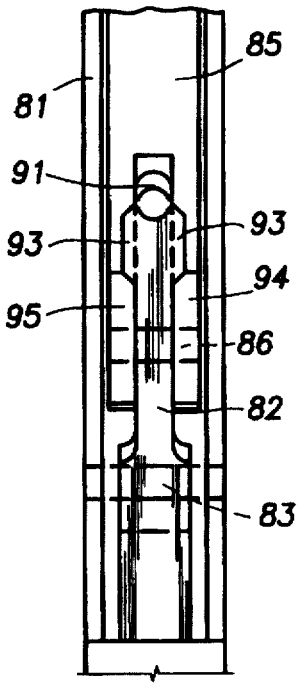
FIG. 6 is a partial side view on line 6—6 of FIG. 5.

As shown in FIGS. 5 and 6, the kickover tool 80, which is run in on wireline, includes an elongated body 81, having a lower arm 82 pivoted thereto be a transverse pin 83. The arm 82 is biased outward by a coil spring 84 or the like, and an upper arm 85 is pivoted thereto by a pin 86. A coil spring 87 which reacts between the upper end portion of the lower arm 82 and an adjacent surface on the upper arm 85 biases the upper end thereof toward the body 81. The upper end on the arm 85 has a threaded bore 88 for connecting a running head 90 thereto. The running head 90 is releasably coupled by a shear pin 97 or the like to the head of a fishing neck 92 included in the collet assembly 53 by which the measuring instrument 17 is latched in the side pocket 24.

The upper portion 91 of the lower pivot arm 82 has a relatively narrow central portion 92 with projections 93 extending laterally outward on the sides thereof. The central portion 92 and the projections 93 define a lug of T-shaped cross-section, referred to herein as a T-lug, that cooperates with the T-shaped slot 35, and the channel 34 shown in FIG. 3 to precisely guide the female connector 50 of the instrument 17 onto the male connector 40, which occurs as the outer wall surfaces 94 of the upper arm 85 are sliding against the inner wall surfaces of the orienting sleeve 32 on opposite sides of the slot 34. The female connector 62 is precisely aligned with the male pin 41 and then telescoped onto it during the final portion of upward movement of the instrument 17 in the side pocket 24. The parts are dimensioned such that the surfaces 64 and 48 engage and stop further movement before the upper end surface of the barrel 60 engages the confronting surface of the connector body 43. The collet shoulders 56 and beams 55, being unsupported at this juncture, flex inward and pass through the latch shoulder 38 and then the shoulders resile back outward above it. As noted above, a downward jarring blow is used to release the tangential shear pin 97 that connects the running head 90 to the mandrel 92 so that the head can be separated therefrom.

Figure 7:
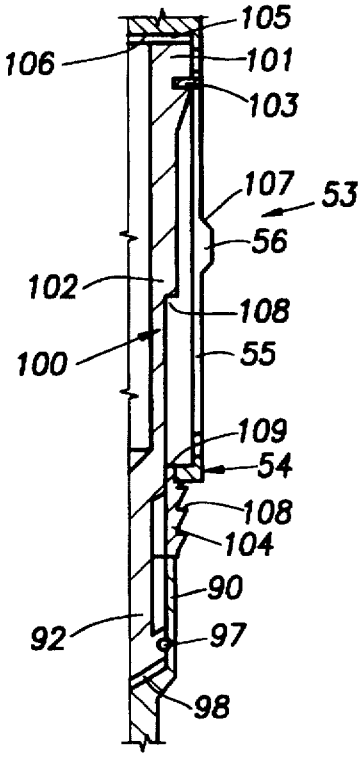
FIG. 7 is an enlarged sectional view of the latch mechanism.

A collet latch assembly that can be used to releasably latch the instrument 17 in the side pocket 24 is shown in further detail in FIG. 7. The sleeve 54 has a locking mandrel 100 mounted therein for movement between upper and lower positions, the fishing neck 92 being integral with the lower end thereof. The mandrel 100 has an enlarged diameter upper portion 101 and a reduced diameter center section 102, the section 102 being underneath the beams 55 when the mandrel is in the upper position, as shown, to allow inward flexure thereof. The mandrel 100 initially is fixed in the upper position by a shear pin 103 that connects the sleeve 54 to the portion 101. The fishing neck 92 is releasably connected to the head 90 by the tangential shear pin 97, there being axial clearance 98 between the lower surface of the neck and the adjacent surface of the head. A similar clearance space 105 exists between the upper end of the mandrel 100 and the adjacent surface 106. In the position shown, the sleeve 54 can be pushed upward through the latch shoulder 38 on the mandrel 20 because the inclined surface 107 will force the beam shoulders 56 jointly inward to a smaller diameter so that they can pass above the latch shoulder. When the electrical connector 40, 50 is made up by upward movement, a wireline jar is actuated to deliver a downward blow which shears both pins 97 and 103. Then as the kickover tool 80 is lowered, the mandrel 92 drops down until the shoulder 108 engages a companion shoulder 109 on the sleeve 54. At this point the enlarged portion 101 is behind the arm shoulders 56 to prevent their inward flexure and thereby latch the instrument 17 in place.

To release the kickover tool 80 and disable it so that it can be moved upward in the tubing 12 without interference, the tool and the gauge 17 are pulled up into the pocket 24 so that the latch 53 seats as previously described and locks in position. Then the wireline is slacked off, after which upward jarring is used to shear the pin 99 that connects the wedge 95 to the body 81. Then a downward jarring blow is used to shear the pin 97, which releases the kickover tool 80 from the latch 53. Now the tool 80 is lowered in the tubing 12 to pivot the arms 85 and 82 inward and into the body 81. The locking wedge 95 can move up and behind the surface 96 of the arm 82 so that the tool 80 can be retrieved to the surface with the arms fully extracted.

Another way to disarm the kickover tool 80 after the latch 53 is released is to lower the same to pivot the lower arm 82 inward about the pin 86 as the arm engages the swage nipple 30. The spring 87 forces the upper arm 85 inward to its retracted position so that the tool 80 can be lowered in the tubing 12. When a suitable obstruction is reached, a downward jarring blow is used to shear the pin 99 and release the wedge 95, which is spring-biased upward to shift it behind the surfaces 96 and lock the arms 82 and 85 in the inner or retracted positions. Then the kickover tool 80 is retrieved to the surface.

OPERATION

In operation and use of the present invention, the side pocket mandrel 20 is installed in the tubing string 12 as it is assembled at the surface from individual joints and run into the well casing 11 with the packer 13 near its lower end. The male electrical connector member 40 will have been installed in the seal bore 37 at the upper end of the offset bore 24 with the pin 41 projecting downward as shown, and with the conductor wire electrically connected to the conductor wire C in the lower end of the cable 21 which is strapped at spaced locations to the outside of the tubing 12 as it is assembled and lowered into the well. The well is put on production so that fluids in the formation enter the casing 11 and flow upward toward the surface through the tubing 12. The packer 13 confines the pressure and flow to the inside of the tubing 12.

To measure the downhole pressure and temperature of the production or casing fluids, a pressure gauge 17 having a female electrical connector member 50 and a collet latch assembly 53 is releasably connected to the kickover tool 80 of the type disclosed and claimed in the above-mentioned U.S. Pat. No. 4,976,314. The kickover tool 80 and the gauge 17 are run into the tubing 12 on wireline together with a jar and sinker bar, until the kickover tool is below the mandrel 20 in which the gauge is to be installed. Then the kickover tool 80 is lifted upward. The upper end 91 of the lower pivot arm 82 engages the helical guide surfaces 33 of the sleeve 32 which causes rotational orientation of the tool 80 in the main bore 23 as the said end seeks the slot 34. When the end portion 91 enters the slot 34, the gauge 17, the arms 82 and 85 and the longitudinal axes of the main and offset bores 23 and 24 are all in the same plane.

Then the T-lug defined by central portion 92 and projections 93 moves up through the slot 34, 35 to positively hold the pivot arms 82, 85 at a certain angle with respect to the axis of the kickover tool body 81 so that the female connector 50 is pulled axially into engagement with the male connector pin 41. At almost full engagement, the shoulders 56 on the collet sleeve 54 encounter the latch shoulder 38 and cause the beams 55 to bow inward so that the beam shoulders 56 are positioned above the latch shoulder. Then the beams 55 flex outward to their relaxed positions with the shoulders 56 holding the gauge 17 in place. The conical surfaces 64 and 48 engage to limit upward movement of the gauge 17 with clearance between the upper end surface of the barrel 60 and the downward facing end surface of the connector body 43.

At this point the wireline jar (not shown) is activated to shear the pins 103 and 97 and release the running head 90. As the kickover tool 80 is lowered, the locking mandrel 100 drops down so that the enlarged portion 101 is behind the shoulders 56 so that the beams 55 can not flex inward. This conditions the collet assembly 53 such that the gauge 17 and female connector 50 are locked in place in the side pocket 24. The kickover tool 80 now is disabled as described above, and removed from the tubing 12 by reeling in the wireline at the surface. The pressures and temperature of fluids flowing upward through the main bore 23 of the side pocket mandrel 20 are sensed by the transducer 67 and converted to electrical signals at 66 which are representative thereof. These signals are transmitted to the surface via the connector assemblies 40 and 50 and the electrical cable 21 for display and/or recording.

To retrieve the gauge 17 from the well at a later time, the same kickover tool 80 described above is used, except for having a retrieving head (not shown) on the upper end of the upper arm 85. When this head is brought up into engagement with the fishing neck 92 on the latch assembly 53, it automatically raises the mandrel 100 to unlock the shoulders 56. Suitable means such as an outside grapple engages projections on the collar 104 (FIG. 7) on the lower end of the sleeve 54. The jar then is operated to jar downward and pull the collet sleeve 54 down past the latch shoulder 38, and the gauge 17 out of the pocket 24. The kickover tool 80 and gauge 17 then are again lowered against a stop to activate the locking wedge 95 and disable the kickover tool, and the assembly pulled out of the tubing 12 as described above. The male connector 40 remains in place in the seal bore 37. The pin 41 and the areas within the skirt 42 remain completely free of any debris that might otherwise settle out in the mandrel 20 under gravity and create problems in, or even prevent, re-engagement of the electrical connector 50 within the pin 41 at a later time.

It now will be recognized that a new and improved side pocket mandrel has been disclosed in which a measuring instrument can be placed and removed without problems due to debris, scale or the like accumulating or settling out in the side pocket region. Since certain changes or modifications may be made in the disclosed embodiment without departing from the inventive concepts involved, it is the aim of the appended claims to cover all such changes and modifications falling within the true spirit and scope of the present invention.

What is claimed is:

1. A side pocket mandrel adapted to be connected in a tubing string, comprising: a body having a main bore aligned with the bore of the tubing and an open-bottomed side pocket laterally offset from said main bore; a seal bore opening through a wall of said body at the upper end of said side pocket; and first electrical connector means mounted in said seal bore and being adapted to be connected to a cable extending upward along the tubing string to the surface, said side pocket being arranged to receive a measuring instrument having second electrical connector means adapted to mate with said first connector means.

2. The mandrel of claim 1 wherein said seal bore and said side pocket have a common axis that is inclined at a low angle with respect to the central axis of said main bore.

3. The mandrel of claim 1 further including surface means on said body for orienting a kickover tool in a manner such that a measuring instrument attached thereto can be position for upward entry into said side pocket.

4. The mandrel of claim 1 further including a latch shoulder on the wall of said side pocket and spaced a distance below said seal bore that is greater than the axial length of said measuring instrument.

5. The mandrel of claim 1 including surface means adjacent said upper end of said side pocket for limiting upward movement of the instrument and for centering the instrument in said side pocket.

6. A side pocket mandrel adapted to receive an instrument that measures a property of fluids flowing through said mandrel, comprising: a body having a main bore and an open-bottomed side pocket bore laterally offset from said main bore, said side pocket bore having a longitudinal axis that inclines downward and inward with respect to the longitudinal axis of said main bore; a cylindrical opening in said body at the top of said side pocket bore and extending to the exterior of said body; first electrical connector means sealing fixed in said opening; a measuring instrument movable upward into said side pocket bore and having a second electrical connector means adapted to mate with first electrical connector means; and latch means for releaseably holding said instrument in said side pocket bore.

7. The mandrel of claim 6 wherein said side pocket bore has an upper portion forming guide and centering surface means cooperable with companion surface means on an upper end portion of said measuring instrument to facilitate mating of said electrical connector means during said upward movement.

8. The mandrel of claim 7 wherein said surface means on said upper portion of said pocket bore includes conical surfaces inclining downward and outward from the lower end of said cylindrical opening to the principal diameter of said side pocket bore.

9. The mandrel of claim 6 where said first electrical connector means includes a downwardly projecting pin member and said second electrical connector means includes socket means arranged to receive said pin member.

10. The mandrel of claim 6 where said latch means includes a shoulder in said bore or said side pocket bore, and a collet assembly including a collet sleeve mounted on the lower end of said instrument, said sleeve providing a plurality of laterally flexible resilient elements adapted to flex inward and bypass said shoulder and selectively operable means for preventing inward flexure of said elements to thereby latch said instruments in said side pocket bore.

* * * * *